US005125129A

United States Patent [19]

Kasper et al.

[11] Patent Number: 5,125,129

[45] Date of Patent: Jun. 30, 1992

[54] INTAKE NOZZLE ASSEMBLY FOR A LIQUID BATH VACUUM CLEANER

[75] Inventors: Gary A. Kasper, Cadillac; Richard G. Harmon, Manton, both of Mich.

[73] Assignee: Rexair, Inc., Troy, Mich.

[21] Appl. No.: 713,059

[22] Filed: Jun. 10, 1991

Related U.S. Application Data

[63] Continuation-in-part of Ser. No. 467,746, Jan. 19, 1990, Pat. No. 5,022,115.

[51] Int. Cl.[5] ..... A47L 9/18

[52] U.S. Cl. ..... 15/353; 55/248; 55/253

[58] Field of Search ..... 15/339, 353; 55/244, 55/248, 250, 253

[56] References Cited

U.S. PATENT DOCUMENTS

| | | | |
|---|---|---|---|
| 2,184,731 | 12/1939 | Brewer | 55/250 X |
| 2,221,572 | 11/1940 | Brock et al. | 55/248 |
| 2,233,167 | 2/1941 | Holm-Hansen | 55/250 X |
| 2,673,619 | 3/1954 | Martin | 55/253 |
| 2,945,553 | 7/1960 | Brock | 55/248 |
| 2,954,095 | 9/1960 | Brock | 55/255 X |
| 4,547,206 | 10/1985 | Sovis et al. | 15/353 X |
| 4,693,734 | 9/1987 | Erickson | 55/248 |

*Primary Examiner*—Chris K. Moore
*Attorney, Agent, or Firm*—Harness, Dickey & Pierce

[57] ABSTRACT

A vacuum cleaner system having an intake nozzle integrally formed with a concave lower portion of a main vacuum canister of a vacuum cleaner system. The intake nozzle protrudes downwardly and communicates with an opening in a convex upper surface of a liquid pan removably attached to the concave lower portion of the main vacuum canister. Attaching the intake nozzle with the concave lower portion of the main vacuum canister allows the interior area of the liquid pan to be more easily cleaned. In an alternative preferred embodiment, an intake member is included which is secured to the concave lower portion of the main vacuum canister. The intake member includes a downwardly protruding tubular member which protrudes outwardly of the lower surface of the main vacuum canister. The tubular member has a first opening which forms an intake port on the side surface of the main vacuum canister and a second opening forming an exhaust port at a lowermost end portion thereof. The intake member further includes a downwardly depending shroud for enabling the main vacuum canister to be more securely supported on a floor. In one preferred embodiment the liquid pan includes a pivotally foldable handle portion for facilitating handling of the liquid pan and a pivotally, removably disposed comb for filtering debris such as hair and pieces of cloth from a liquid filtering agent when the filtering agent is emptied from the pan. In another alternative preferred embodiment the liquid pan comprises a six-sided shape and includes a pair of pivotally coupled handles foldable upwardly into abutting contact to form a single handle by which the liquid pan assembly may be more easily manually handled and articulated.

20 Claims, 9 Drawing Sheets

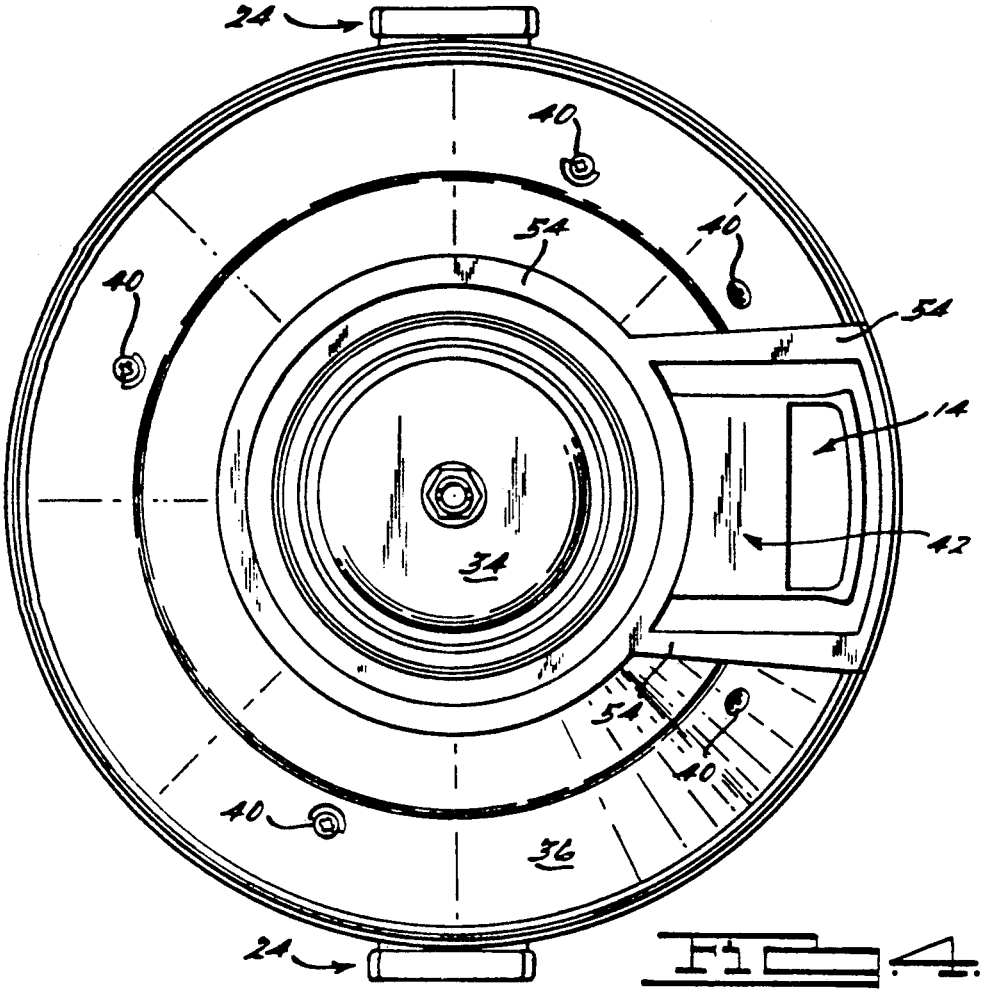
FIG. 4.
FIG. 2.
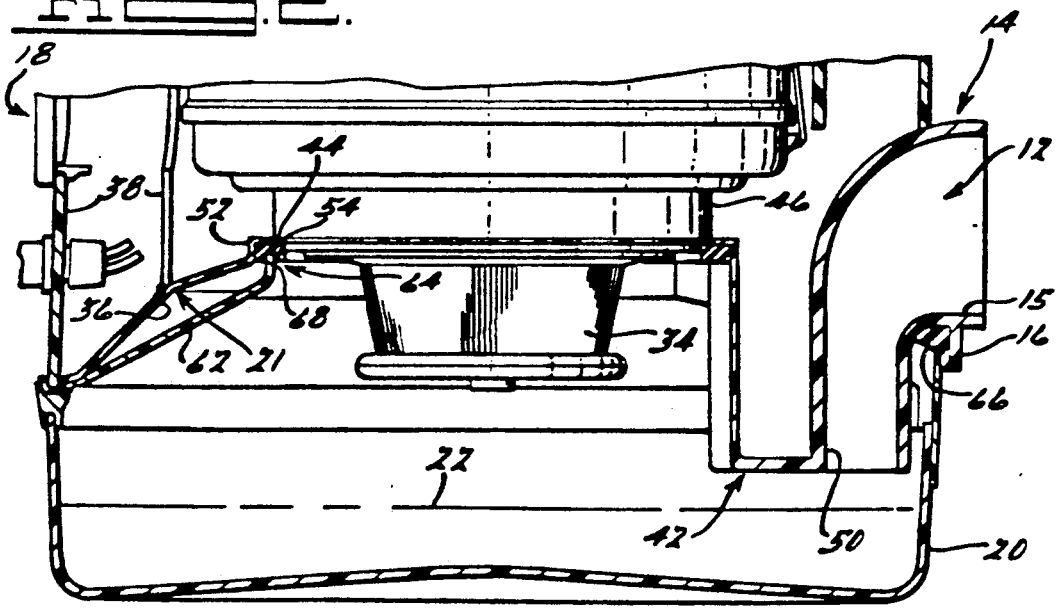

INTAKE NOZZLE ASSEMBLY FOR A LIQUID BATH VACUUM CLEANER

CROSS-REFERENCE TO RELATED APPLICATION

This application is a continuation-in-part of U.S. application Ser. No. 467,746, filed Jan. 19, 1990, which issued as U S. Pat. No. 5,022,115, Jun. 11, 1991.

BACKGROUND OF THE INVENTION

1. Technical Field

This invention relates to liquid bath vacuum cleaner systems and, more particularly, to an intake nozzle assembly for use with a liquid bath vacuum cleaner.

2. Discussion

Liquid bath vacuum cleaners are used in a wide variety of residential and industrial applications. These vacuum cleaners typically include a main vacuum canister with a removably attached liquid pan. An intake nozzle of the pan matingly engages with an opening in the canister when the pan is attached to the canister to allow dust and dirt entrained air to be ingested by a vacuum force through the intake nozzle into the area defined by the liquid pan. The pan is removed periodically from the main vacuum canister and flushed out with water or another cleaning solution as it is articulated into various positions.

Although liquid pan and canister combinations as described above operate well to receive and trap dust and dirt particles entrained in ingested air, the attached intake nozzle tends to impede cleaning by trapping dirt when flushing out the pan. In addition, the shape of many heretofore designed liquid pans usually requires that the pan be held and manipulated with both hands as the liquid cleaning agent is emptied therefrom. Accordingly, since two hands are often required to handle the liquid pan, it can at times be difficult for an individual to catch unwanted debris such as cloth, hair, carpet fibers, etc., from being drained from the liquid pan as the liquid filtering agent is emptied from the pan.

In U.S. Pat. No. 5,022,115, an intake nozzle assembly was disclosed which represented a significant step forward in alleviating the problems of prior art intake nozzle assemblies. The above-mentioned intake nozzle assembly included a main vacuum canister of a vacuum cleaner assembly having an intake nozzle extending downwardly therefrom, and a liquid pan having an opening to matingly receive the intake nozzle.

While the above-mentioned invention has proved to be a significant success, it would be even further desirable to provide some means by which the main vacuum canister can be more evenly supported in a stabilized manner when rested on a floor while the liquid pan is removed.

It is therefore a principal object of the present invention to provide a liquid pan for a liquid bath vacuum cleaner which may be more easily cleaned than conventional pans for liquid bath vacuum cleaners.

It is a further object of the present invention to provide a main vacuum canister having a attached intake nozzle operable to receive dust and dirt entrained air ingested by the vacuum cleaner and to direct the ingested air towards a removably attached liquid pan.

It is still a further object of the present invention to provide a removable liquid pan having an opening operable to communicate with an intake nozzle of a main vacuum canister to thereby allow airflow through the nozzle and the opening into an interior area of the liquid pan.

It is another object of the present invention to provide an intake means for a main vacuum canister of a vacuum cleaner, which intake means includes an integrally formed tubular intake port, and where the intake means may be removed from the lower surface of the main vacuum canister.

It is yet another object of the present invention to provide an intake means which may be coupled to a lower surface of a main vacuum canister, which intake means includes a tubular intake port protruding outwardly of the lower surface of the main vacuum canister, and which intake means further includes a downwardly depending shroud extending outwardly of the lower surface of the main vacuum canister a distance at least equal to a distance at which the tubular intake port extends outwardly of the lower surface, to thereby rest on a floor in a level manner and support a main vacuum canister secured thereto in a level, stabilized manner.

It is yet another object of the present invention to provide a removable liquid pan for a liquid bath-type vacuum cleaner, where the liquid pan incorporates a handle portion which is pivotally secured to a portion of the liquid pan and foldably positionable to enable it to be stowed away when the liquid pan is coupled to a main vacuum canister of the vacuum cleaner system.

It is still another object of the present invention to provide a liquid pan for a liquid bath-type vacuum cleaner system, where the liquid pan incorporates a pivotally, removably disposed comb, and where the comb operates to filter unwanted debris such as pieces of cloth, hair, carpet strands and the like from a liquid filtering agent contained within the pan as the filtering agent is emptied from the pan.

SUMMARY OF THE INVENTION

The above and other objects are provided by a liquid bath vacuum cleaner system having an intake nozzle assembly in accordance with preferred embodiments of the present invention. In one preferred embodiment, the vacuum cleaner system generally includes a main vacuum canister, an intake nozzle and a removable pan. The main vacuum canister has a lower surface from which the intake nozzle protrudes outwardly. The intake nozzle enables debris to be intaked into the pan.

The pan is removably connected to the lower surface of the main vacuum canister and includes an upper surface having an opening in communication with the intake nozzle. By incorporating the intake nozzle with the main vacuum canister rather than with the liquid pan, the ease with which the pan may be periodically cleaned is improved. More specifically, the pan may be articulated into various positions and dirt and debris contained therein may be flushed out more easily than if the intake nozzle were incorporated with the pan.

In an alternative preferred embodiment of the present invention an intake means is included which incorporates an integrally formed, tubular member. The tubular member extends outwardly of a lower surface of a main vacuum canister of the vacuum cleaner assembly and may be removably secured to the lower surface of the main vacuum canister. In this embodiment the intake means further includes a downwardly depending shroud which extends a distance outwardly of the lower surface of the main vacuum canister at least equal to the distance which the tubular member extends from the lower surface. Accordingly, when the liquid pan is removed from the main vacuum canister, the shroud of the intake means supports the main vacuum canister when the canister is placed on a floor or other like surface in a level and stabilized manner relative to the floor without interference from a lowermost tubular end portion of the tubular member.

In another alternative preferred embodiment of the present invention, a liquid pan assembly is included which incorporates a handle portion and a comb. The handle portion enables the liquid pan to be handled and manipulated more easily as the contents of the pan are emptied. The handle may be pivotally secured to a portion of the pan to further enable it to be foldably stowed away when the pan is secured to the main vacuum canister.

The comb enables pieces of cloth, hair, carpet fibers and the like to be filtered from the contents of the pan as the contents are emptied from the pan. The comb may be removably, pivotally secured to a portion of the pan to enable it to be removed for cleaning, and also for providing easier access to the interior area of the pan.

In another preferred alternative embodiment of the present invention a liquid pan assembly thereof comprises a six-sided shape and a pair of pivotally mounted handles. The handles are operable to be pivotally moved into a stowed-away position when the liquid pan assembly is attached to the lower portion of a main vacuum canister, and pivotally moved upwardly into abutting engagement with each other to form a single handle to enable the liquid pan assembly to be more easily manually handled and articulated.

BRIEF DESCRIPTION OF THE DRAWINGS

The various advantages of the present invention will become apparent to one skilled in the art by reading the following specification and subjoined claims and by referencing the following drawings, in which:

FIG. 2 is a fragmentary view of the system showing the intake nozzle assembly and the liquid pan in cross-section;

FIG. 4 is a view of the lower surface of the main vacuum canister taken along section lines 4—4 of FIG. 1;

DETAILED DESCRIPTION OF THE PREFERRED EMBODIMENTS

Figure 1:
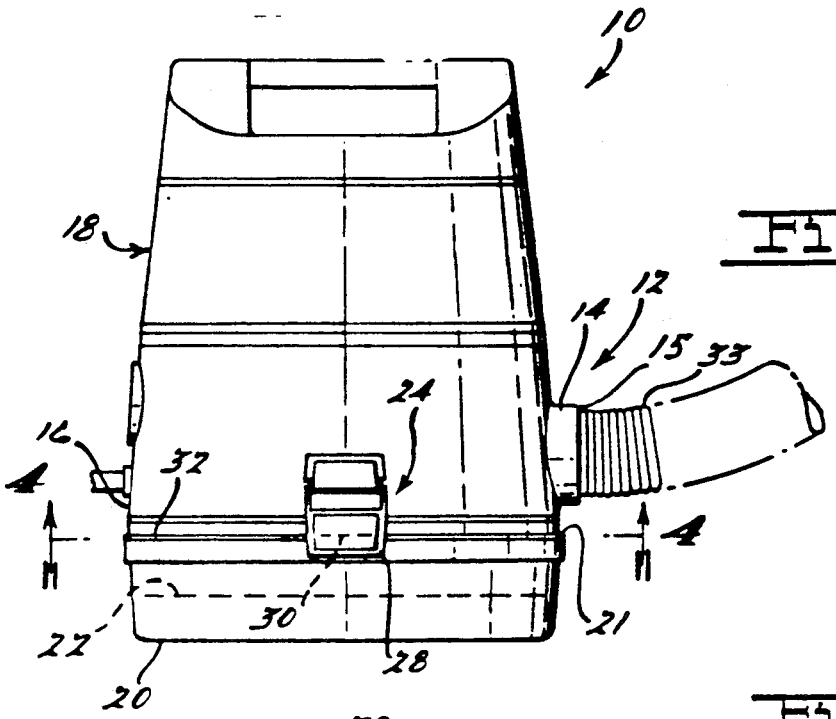
FIG. 1 is a side elevational view of a vacuum cleaner system incorporating the intake nozzle assembly of the present invention.

In FIG. 1 a vacuum cleaner system 10 incorporating an intake nozzle assembly 12 in accordance with the present invention is shown. The intake nozzle assembly 12 generally includes an intake nozzle 14 integrally formed with or otherwise attached to a generally cylindrical, lower side portion lower 16 of a main vacuum canister 18 to thereby form an intake port 15. A preferably cylindrically-shaped liquid pan 20 is removably connected to a lower surface 21 of the main vacuum canister 18 and holds a liquid filtering agent 22 such as water. The intake nozzle 14 and pan 20 are both preferably formed of a rigid plastic by injection molding. Latches 24, of which only one can be seen in FIG. 1, allow the liquid pan 20 to be removably attached to lower surface 21 (shown more clearly in FIG. 4) of the main vacuum canister 18. The latches 24, which are well known in the art, are spring biased to allow a lower portion 28 of each latch to abuttingly engage with shoulder portions 30 (of which only one is shown by a hidden dashed line) protruding from opposing sides of an upper edge 32 of the liquid pan 20.

In operation, dust and dirt entrained air is ingested in by the system 10 via a removable vacuum hose 33 coupled to the intake port 15 and the intake nozzle 14. The air is then directed downwardly into the liquid pan 20. The ingested air impinges the liquid filtering agent 22 in the pan 20 and the inner walls of the pan 20. The inner walls of the pan 20 will typically be wet from the slight sloshing and agitation of the water 22, which is created by the vacuum force of the system 10. The liquid 22 operates to trap dust and dirt particles entrained in the ingested air before the air is expelled from the system 10.

Referring now to FIG. 2, the intake nozzle 14 and liquid pan 20 are shown in assembly relation in greater detail. A separator 34 is also shown and is adapted to partially reside within the pan 20. The lower surface 21 of the main vacuum canister 18 includes a lower cover 36, preferably concave in shape, secured to lower frame portions 38 of the main vacuum canister 18 by screws 40 (shown in FIG. 4). The lower cover 36 includes a downwardly protruding shoulder portion 42, preferably integrally formed with the lower cover 36 adjacent the intake nozzle 14, for helping to keep the dirt-entrained, ingested air in close proximity with the liquid filtering agent 22. This enhances the ability of the filtering agent 22 to trap the dirt particles therein.

The lower cover 36 also includes an annular sealing ring 44 concentrically disposed within the main vacuum canister 18 and secured to a lower portion of a fan housing 46 by screws (not shown). Integrally formed with the lower cover 36 is the intake nozzle 14 which protrudes downwardly in a curved fashion from the lower side portion 16 of the main vacuum canister 18. A lowermost tubular end portion 50 of the intake nozzle 14 protrudes downwardly from the lower cover 36 and is adapted to reside partially within the liquid pan 20 when the pan 20 is attached to the main vacuum canister 18.

From FIG. 2 it can also be seen that the lower cover 36 includes a shoulder portion 52 which is adapted to abut an annular gasket 54. The gasket 54 is secured, preferably by an adhesive, to the annular sealing ring 44 and a portion of the lower cover 36. The gasket 54 is shaped so as to circumscribe the separator 34 and the downwardly protruding, lowermost tubular end portion 50 of the intake nozzle 14 (shown more clearly in FIG. 4). An adhesive that works particularly well in securing the gasket 54 is available from the 3M Corporation under Product No. 1022.

With further reference to FIG. 2, it can be seen that the liquid pan 20 includes an upper convex surface 62 having a concentrically disposed annular opening 64 (shown more clearly in FIG. 3) for receiving the separator 34, and a slot-like opening 66 for receiving a portion of the lowermost tubular end portion 50 of the intake nozzle 14. The upper convex surface 62 further includes an upwardly protruding shoulder portion 68 which circumscribes the area defined by the annular opening 64 and the slot-like opening 66. The shoulder portion 68 is adapted to forcibly abut the gasket 54 to thereby form a relatively air-tight seal between the upper convex surface 62 and the lower cover 36 when the liquid pan 20 is attached to the main vacuum canister 18.

When the liquid pan 20 is periodically cleaned, the openings 64 and 66 in the upper surface 62 of the pan 20 allow the interior area of the pan 20 to be more easily cleaned when articulating the pan 20 into an upside down position. With prior art containers, the intake nozzle, which would typically have been formed with the upper surface of the pan, would have impeded the easy and efficient removal of dust and dirt debris from the interior area of the pan by tending to trap dirt particles therein when the pan was articulated into an upside down position. The present invention thus greatly increases the ease with which the pan of a liquid bath vacuum cleaner system may be periodically cleaned.

Figure 3:
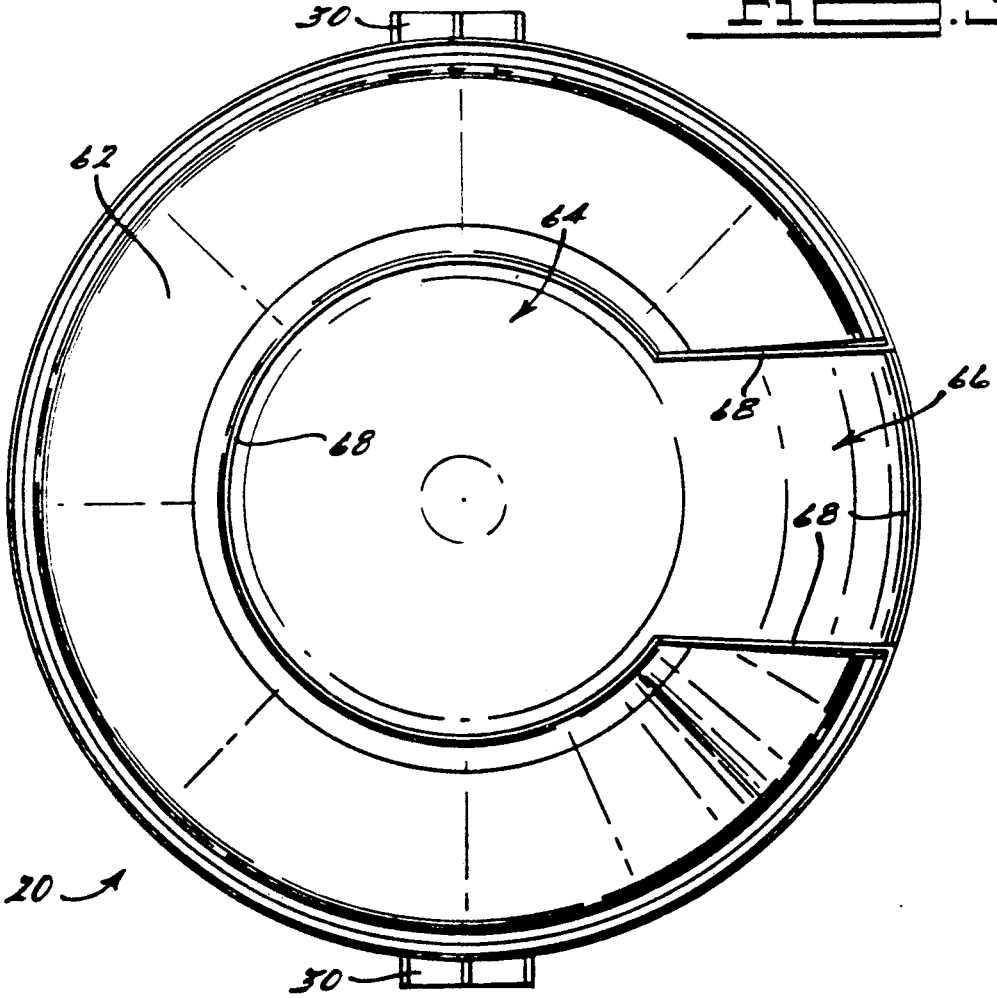
FIG. 3 is a plan view of the liquid pan.

In FIG. 3, the convex upper surface 62 and openings 64 and 66 in the convex upper surface 62 are both shown more clearly. It should be appreciated that the openings 64 and 66 could readily take a variety of shapes, and that the upper surface 62 need not be convex in shape, but could instead take other forms if the lower surface 21 of the main vacuum canister 18 is formed in a complimentary manner. In FIG. 4 the intake nozzle 14 and the downwardly protruding shoulder portion 42 of the lower cover 36 are both shown in more detail together with the gasket 54 which circumscribes them.

Figure 5:
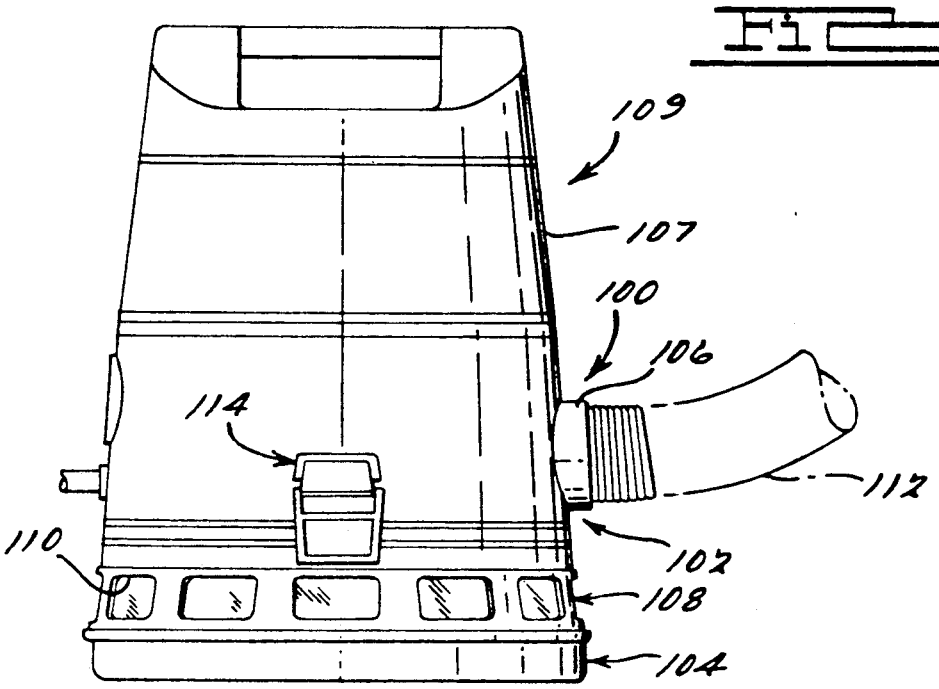
FIG. 5 is an illustration of an alternative preferred embodiment of the present invention.

Referring now to FIG. 5, an alternative preferred embodiment 100 in accordance with the present invention is illustrated. This embodiment 100 generally includes an intake means in the form of an intake member 102 and a liquid pan assembly 104. The intake member 102 includes an integrally formed tubular intake port 106 and an integrally formed shroud 108. The shroud 108 is adapted to rest nestably over a portion of liquid pan assembly 104 when the pan is secured to a main vacuum canister 107 of a vacuum cleaner system 109. The shroud preferably includes a plurality of circumferentially-spaced openings 110 to enable a user to view more clearly the contents of liquid pan assembly 104, to thereby more easily determine when a liquid filtering agent contained within assembly 104 is to be emptied and replaced.

In general operation, the tubular intake port 106 enables dust and dirt particulates ingested through a removably coupled vacuum hose 112 to be directed downwardly into the liquid filtering agent contained within liquid pan assembly 104. When the liquid filtering agent becomes sufficiently contaminated, the liquid pan assembly 104 may be removed via manually operated latching members 114 (as shown in FIGS. 1 and 5), and the filtering agent emptied from the pan assembly 104.

Figure 8:
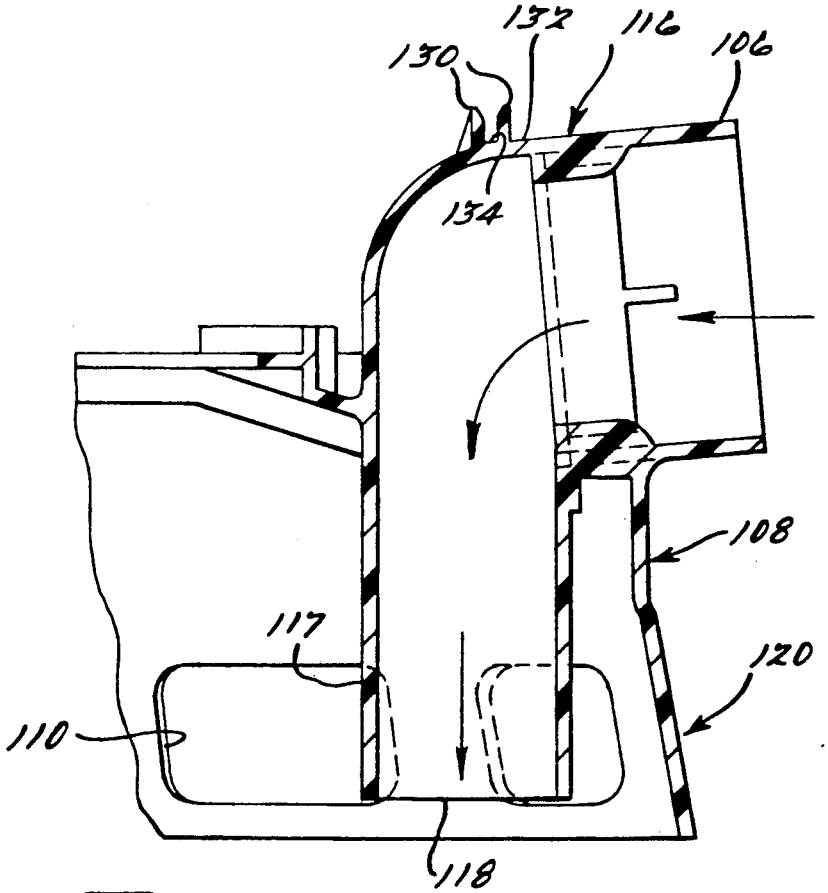
FIG. 8 is a fragmentary, side cross-sectional view of the tubular intake portion of the intake means taken along section lines 8—8 of FIG. 6.
Figure 6:
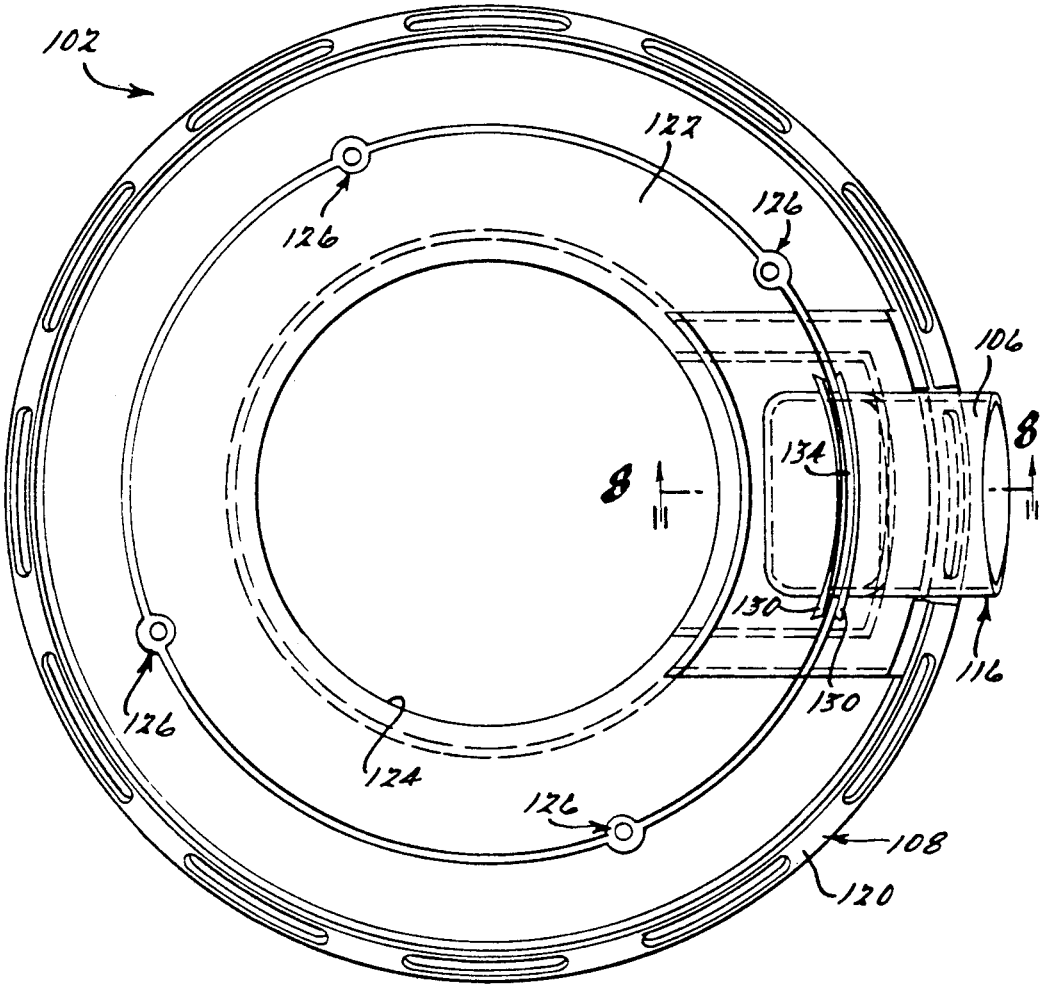
FIG. 6 is an elevational plan view of the intake means of the present invention.
Figure 7:
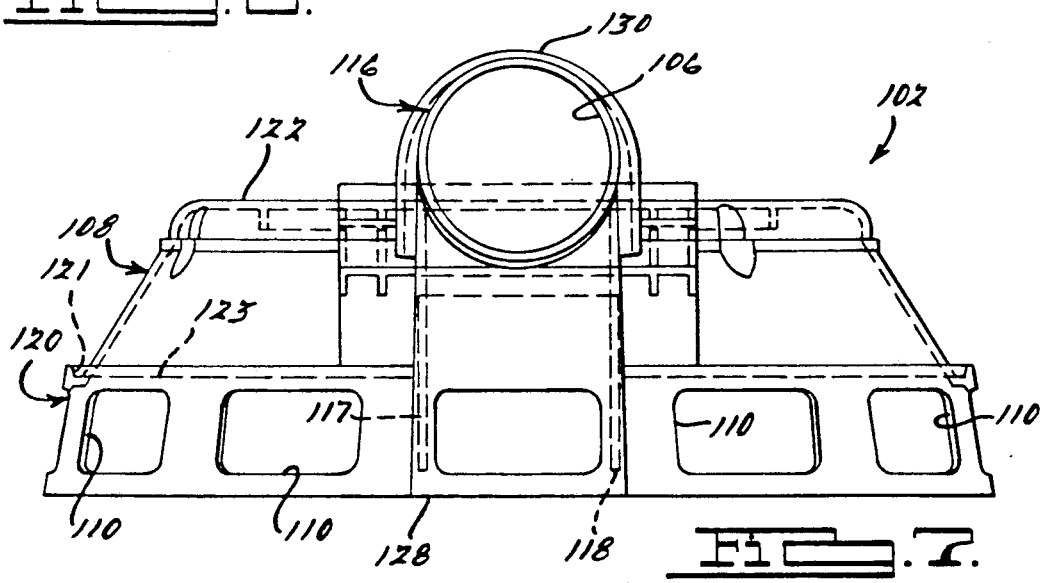
FIG. 7 is an elevational side view of the intake means showing more clearly the generally circular intake port thereof.

With reference to FIGS. 6–8, the intake member 102 is shown in more detail. Referring specifically to FIGS. 6 and 7, the intake member 102 includes a downwardly extending, curved tubular member 116 having a first end forming intake port 106 and a second end forming a lowermost tubular end portion 117 and an exhaust port 118. Intake member 102 further includes the integrally formed shroud 108, which has a skirt portion 120. The shroud 108 has a lip portion 121 which partially defines a circumferentially disposed channel 123. A top portion 122 having a generally circular, coaxially disposed opening 124 is also integrally formed with the intake member 102. The top portion 122 includes a plurality of boss portions 126 for securing the intake member to an undersurface of the main vacuum canister 107. The intake member 102 is generally circular in shape and when coupled to the undersurface of main vacuum canister 107 provides the appearance of a generally integrally formed portion of canister 107.

With reference specifically to FIG. 7, a lower edge surface 128 of skirt portion 120 extends downwardly a distance that is slightly greater than the distance which the exhaust port 118 of lowermost tubular end portion 117 extends. Since lower edge surface 128 extends downwardly slightly farther than exhaust port 118, when the liquid pan assembly 104 is uncoupled from the vacuum cleaner system 109, the system 109 may rest on a floor or other surface in a level and stabilized manner on lower edge surface 128. Accordingly, it should be appreciated that intake member 102, and particularly the lower edge surface 128 of skirt portion 120, provides a significant advantage in that it enables the vacuum cleaner 109 to be securely supported in a level manner without wobbling or like movement on a floor while liquid pan assembly 104 is removed for emptying, cleaning or other purposes.

Referring specifically to FIG. 8, the lowermost tubular end portion 117 of tubular member 116 extends downwardly a distance to place the exhaust port 118 closely adjacent a surface of the liquid filtering agent contained within the liquid pan assembly 104. Thus, as dust and dirt particulate entrained air is ingested by the vacuum cleaner system 109 through intake port 106, the dust and dirt particulate entrained air is forced to impinge the surface of the liquid filtering agent, which enables the filtering agent to trap the great majority of dust and dirt particulates.

With further reference to FIGS. 5, 6 and 8, the tubular member 116 includes a pair of outwardly protruding rim portions 130. Rim portions 130 extend circumferentially around a portion of neck portion 132 of tubular member 116 to provide a groove 134 into which a lower edge portion of the main vacuum canister 108 may be inserted in a "tongue-and-groove" fashion.

Figure 9:
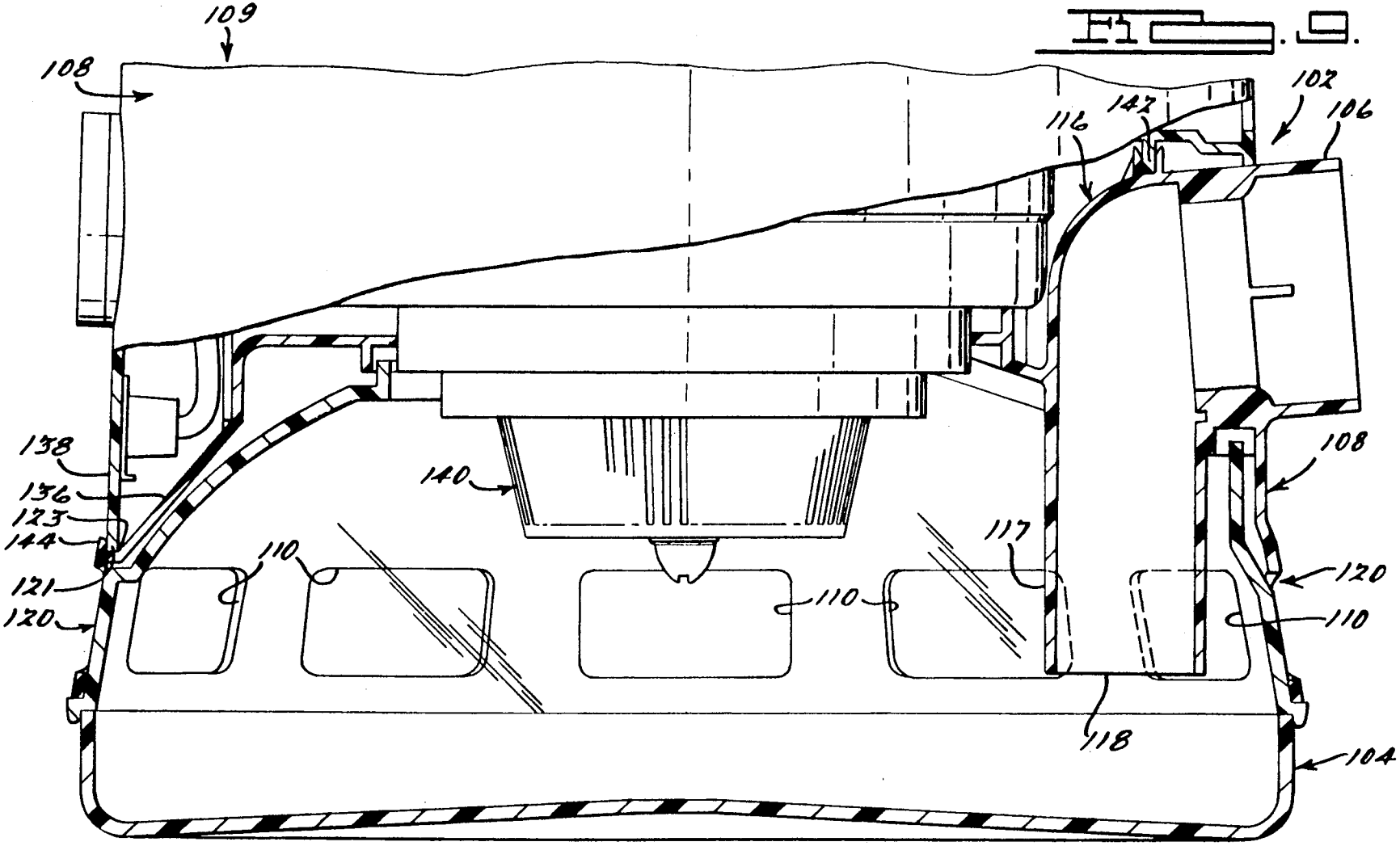
FIG. 9 is a cross-sectional view of the intake means of the present invention coupled to a lower portion of a main vacuum canister, and further showing in cross-section a liquid pan assembly of the present invention coupled to the intake means.

In FIG. 9, it can be seen more clearly how the intake member 102 fits nestably within a generally concave shaped lower surface 136 of the main vacuum canister 107 to provide the appearance of a generally integrally formed portion of a lower side surface 138 of the vacuum cleaner system 109. FIG. 9 also illustrates how the liquid pan assembly 104 fits nestably within the shroud 108 of intake member 102. The generally circular opening 124 enables a separating element 140 to protrude therethrough. The rim portions 130 couple in a tongue-and-groove fashion with a lower edge portion 142 of main vacuum canister 107 to further help secure the intake member 102 to the canister 107.

The lip portion 121 of shroud 108 and channel 123 further cooperate with a lower edge portion 144 of lower side surface 138 to help secure the intake member 102 securely coaxially with the main vacuum canister 107.

Figure 10:
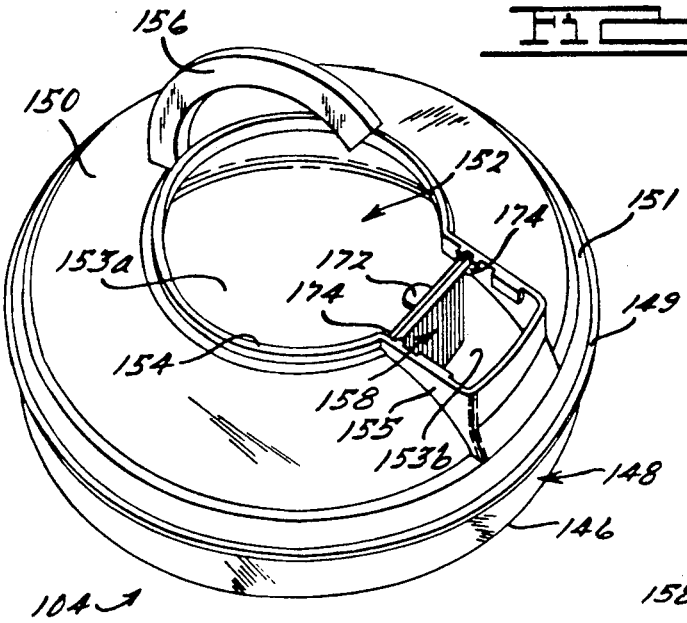
FIG. 10 is a perspective view of the liquid pan assembly shown in FIG. 8.

Referring now to FIG. 10, the liquid pan assembly 104 is illustrated detached from the main vacuum canister 107. The liquid pan assembly 104 generally comprises a lower surface 146, a generally circular side surface 148 having a circumferentially extending, outwardly protruding shoulder portion 149 and a slightly inwardly turned wall portion 151, and a slightly convex-shaped top surface 150.

Top surface 150 includes a generally "key-shaped" opening 152 having a partially circular portion **153*a* and a partially square-shaped portion 153*b*. An upstanding flange 154 extends about the periphery of key-shaped opening 152 and helps to partially define an upwardly extending mouth portion 155. A handle portion 156 is pivotally, removably secured to a portion of flange 154. Partially circular portion 153*a* allows a substantial portion of separating element 140 to protrude into an interior area of the liquid pan assembly 104 when the pan assembly 104 is secured to the main vacuum canister 107. Portion 153*b* of key-shaped opening 152 enables the lowermost tubular end portion 117 of tubular member 116 to similarly protrude into the interior area of the pan assembly 104**.

The upwardly extending mouth portion 155 of top surface 150 further helps to provide a seal between the top surface 150 and the generally concave-shaped lower surface 136 of the main vacuum canister 107. Although not illustrated, it should be appreciated that a conventional gasket or other sealing means may be disposed around the perimeter of key-shaped opening 152 to further ensure that a good seal is effected between the top surface 150 and the lower surface 136 of main vacuum canister, 108 when the pan assembly 104 is secured to the canister 107.

The outwardly protruding shoulder portion 149 enables a portion of latching member 114 (FIG. 5) to grip thereon and securely hold the pan assembly 104 to the canister 107. The inwardly turned wall portion 151 enables the portion of pan assembly 104 defined by wall portion 151 to fit nestably within the skirt portion 120 of intake member 102, as illustrated in FIG. 9.

Figure 11:
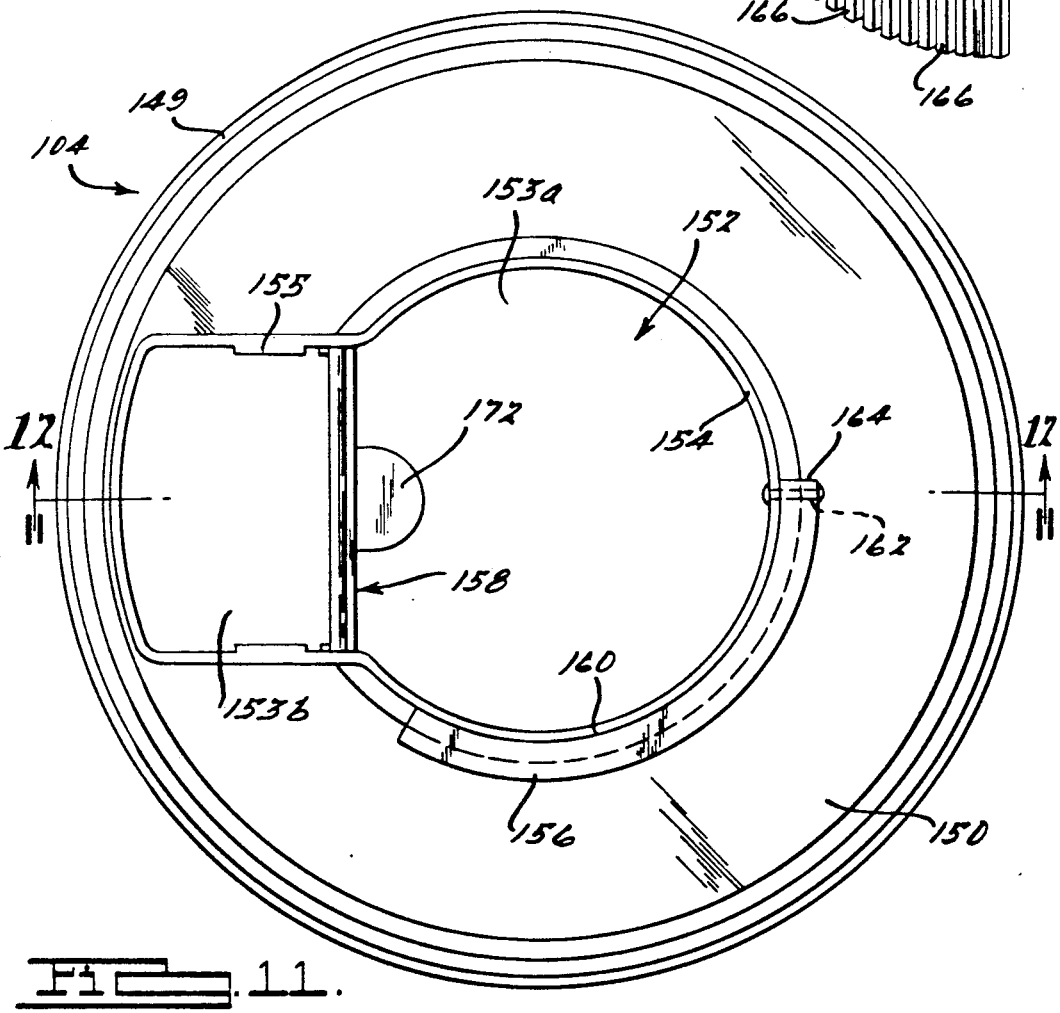
FIG. 11 is a plan view of the liquid pan assembly of FIG. 10.

Referring to FIG. 11, the handle portion 156 is shown in its foldably collapsed, stowed-away position. The curved shape of handle portion 156, the inner surface 160 of which has a radius preferably just slightly larger than partial circular opening **153*a*, enables handle portion 156 to fit neatly and conformably about flange 154 when in the stowed-away position so as not to interfere with the structure of lower concave surface 136 of the main vacuum canister 107 when the pan assembly 104 is secured to the canister 107. To enable pivotal movement of the handle portion 156, a rivet 162 or other like means capable of pivotally securing two members may be inserted cross-sectionally through an end portion 164 of handle portion 156 and through a portion of flange 154. It should be appreciated that many other conventional forms of pivotal attachment such as threaded nut and bolt assemblies may be incorporated to secure the handle portion 156 pivotally to flange 154**.

Figure 13:
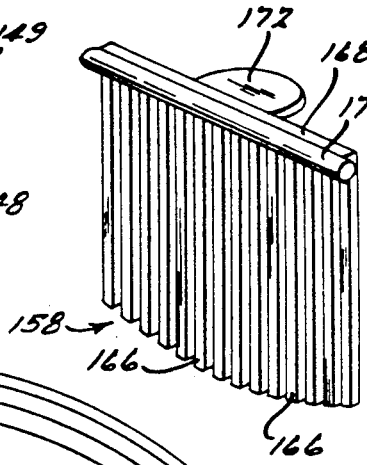
FIG. 13 is an elevational perspective view of a comb of the present invention which may be pivotally, removably secured to a portion of the liquid pan assembly.
Figure 12:
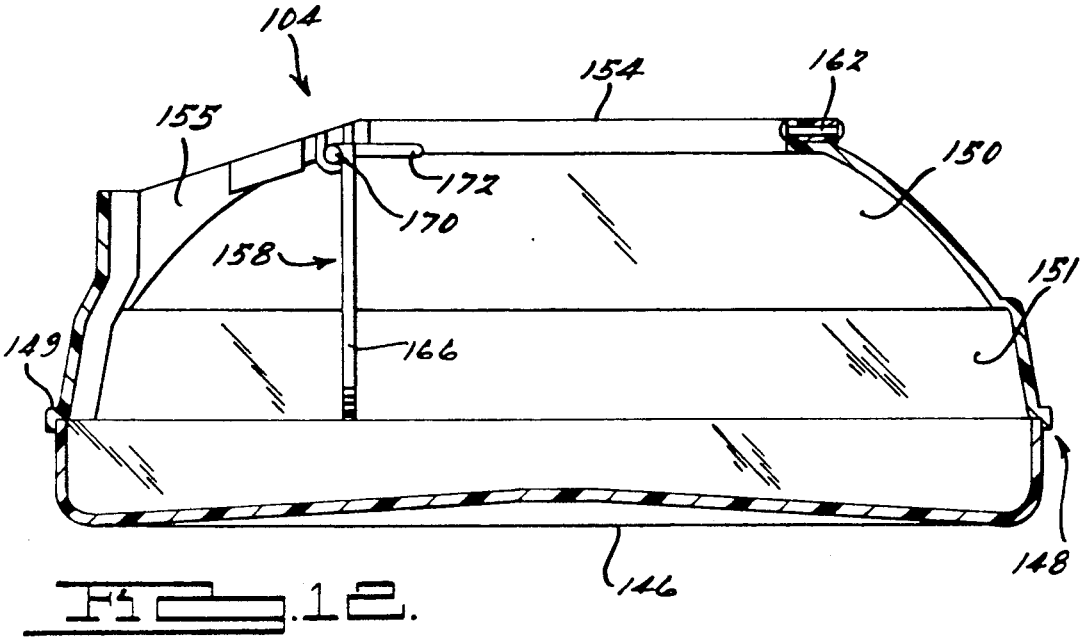
FIG. 12 is a side cross-sectional view of the liquid pan assembly taken along section lines 12—12 of FIG. 11.

Referring now to FIGS. 12 and 13, the comb 158 of pan assembly 104 is shown. With specific reference to FIG. 13, comb 158 includes a plurality of independent, elongated tines 166 affixed to a shoulder portion 168 of a generally circular pivot bar 170. Further secured to shoulder portion 168 is a tab member 172 which enables the comb to be moved pivotally by manually pressing thereon. The pivot bar 170 is further offset from a centerline running vertically through the tines 166 to enable the comb 158 to hang freely at an angle when the pan assembly is articulated during emptying. This enables the comb 158 to substantially block the square-shaped opening **153*b* as the liquid pan is tipped to empty its contents, to further help trap any debris that might otherwise escape entrapment by the tines 166. The comb 13 is removably inserted into generally U-shaped channels 174 formed on inner surfaces of upwardly extending mouth portion 155 of top surface 150, one of which is shown most clearly in FIG. 12**.

By coupling comb 158 removably with pan assembly 104, the comb may be lifted out and periodically cleaned when needed. The comb 158 functions like a filter to help remove hair, pieces of cloth, carpet fibers and other like debris trapped within the liquid filtering agent contained within pan assembly 104 when the filtering agent is emptied from the pan assembly 104, thereby reducing the chance of clogging a sink, drain tub, or other like receptacle with such debris.

Figure 14:
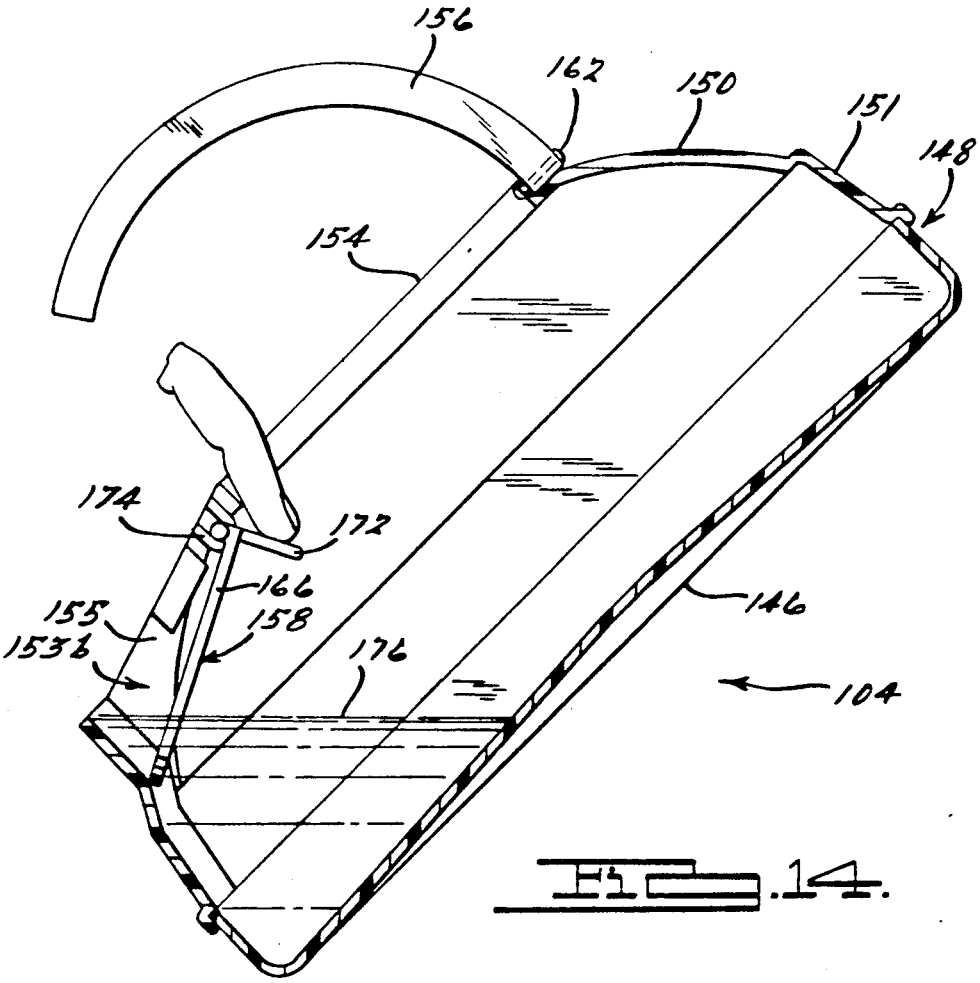
FIG. 14 is an illustration of how the comb may be pivotally moved into the flow path of a liquid filtering agent being emptied from an interior of the liquid pan assembly.

With reference to FIG. 14, the step of emptying liquid pan assembly 104 is shown. Initially, the handle portion 156 enables an individual to manipulate the liquid pan assembly 104 by gripping the handle portion 156 with a single hand. In some instances, the contents of liquid pan assembly 104 would otherwise make it necessary to handle the pan assembly 104 with two hands to avoid uncontrolled spillage. By incorporating the handle portion 156 and tab member 172 of the comb 158, the pan assembly 104 may be lifted and tilted by gripping handle portion 156 with one hand, and pivotally urging the comb 158 into a position with a finger of the other hand to place the comb 158 directly in the flow path of a liquid filtering agent 176. Thus, emptying of liquid pan assembly 104 can be easily accomplished while simultaneously manually urging the comb 158 into a position to help filter unwanted debris trapped within the liquid filtering agent 176.

The pan assembly 104 is preferably made from a lightweight, high strength material such as plastic, and with conventional construction techniques such as injection molding and spin welding. Top surface 150 and side wall portion 151 are preferably made of a translucent material such as clear plastic to enable the liquid filtering agent to be visually inspected periodically to more easily determine when the filtering agent needs to be replaced. In this regard, when the pan assembly 104 is coupled to the main vacuum canister 107, the openings 110 in skirt portion 120 of intake member 102 further help this visual inspection to be accomplished. Thus, there is no need to remove the pan assembly 104 from the main vacuum, canister 107 to determine if the liquid filtering agent 176 needs to be replaced. Accordingly, it should be appreciated that the intake member 102 and liquid pan assembly 104 of the present invention operate cooperatively to enable much more convenient use of vacuum cleaner system 109.

Figure 15:
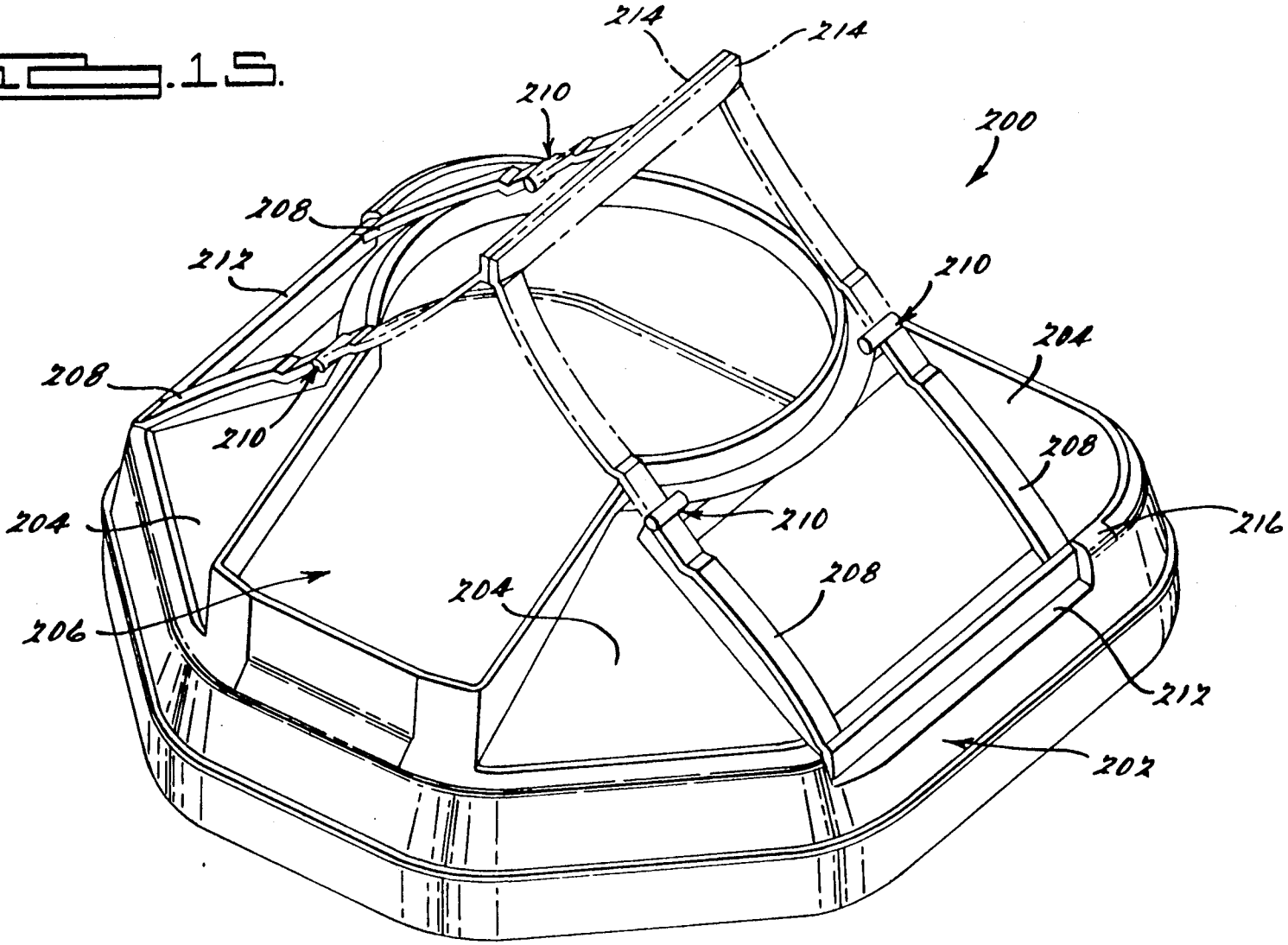
FIG. 15 is a perspective elevational view of a six-sided liquid pan assembly incorporating a pair of pivotally mounted handles in accordance with an alternative preferred embodiment of the present invention.

Referring now to FIG. 15, there is shown a six-sided liquid pan assembly 200 in accordance with another alternative preferred embodiment of the present invention. The liquid pan assembly 200 comprises a modified hexagonal shape having a side surface 202, a generally planar top surface 204 and a key-shaped opening 206. The top surface 204 includes a pair of handles 208 which are each coupled to portions of the top surface 204 via pairs of conventional pivot assemblies 210. The handles 208 are movable pivotally into upstanding, abutting contact, as shown in phantom, and foldable downwardly into a stowed away position as shown in elevation. To facilitate stowed away storage of the handles 208, the side surface 202 may include a pair of recessed areas 212 which enable the handles 208 to fold downwardly into a position wherein top portions 214 of the handles 208 are relatively flush with an upper edge 216 of the side surface 202.

Figure 16:
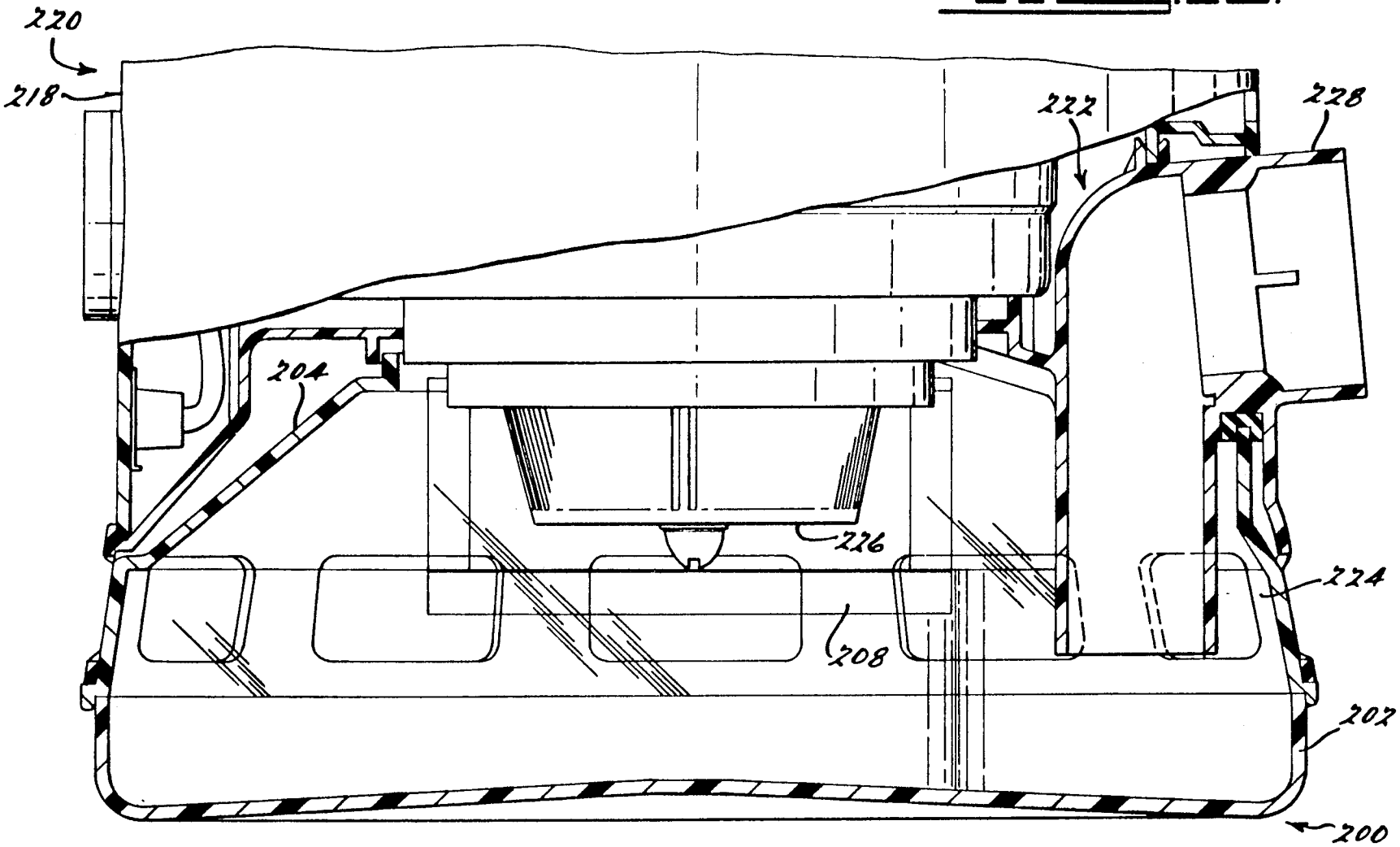
FIG. 16 is a cross-sectional side view of the liquid pan assembly of FIG. 15 coupled to a main vacuum canister.

With reference to FIG. 16, the manner in which the liquid pan 200 connects with a lower side surface 218 of a main vacuum canister 220 is shown. The lower side surface 218 preferably comprises a six-sided shape symmetrical to the six-sided shape of the liquid pan 200. The liquid pan 200 couples to the lower side surface 218 in a manner generally identical to the manner in which liquid pan 104 couples to main vacuum canister 107, as described in connection with the drawing of FIG. 9.

An intake member 222 having a shroud 224 shaped in a six-sided configuration generally symmetrical with the liquid pan 200 is included to enable the liquid pan 200 to fit nestably therewithin. The key-shaped opening 206 permits a separator 226 of the main vacuum canister 220 and an intake port 228 of the intake member 222 to protrude into an interior area of the liquid pan 200. An optional gasket (not shown) may be incorporated to circumscribe the perimeter of key-shaped opening 206 to seal the opening 206 when the liquid pan 200 is secured to the lower surface 218 of the main vacuum canister 220. It should also be appreciated that the liquid pan 200, as well as the liquid pan assembly 104, could be removably coupled via a variety of methods, and even to the shroud 224 if so desired.

The construction of the intake member 222 and shroud 224 is essentially identical to the construction of intake member 102 described in connection with FIGS. 5–14, with the exception of the six-sided configuration of the shroud 224. Although not shown in FIGS. 15 and 16, the comb 158 of liquid pan 104 could readily be incorporated into the liquid pan 200 if so desired.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A vacuum cleaner intake assembly comprising:

a main vacuum canister having a lower surface and a side surface;

intake means for ingesting dust and dirt particulate entrained air, said intake means being operably associated with said lower and side surfaces of said main vacuum canister, said intake means forming an intake port within a portion of side surface of said main vacuum canister;

said intake means including a lowermost tubular end portion protruding outwardly of said lower surface of said main vacuum canister and in communication with said intake port;

said intake means further including a shroud protruding outwardly of said lower surface of said main vacuum canister;

pan means for containing a filtering agent in an interior area thereof, said pan means having lower, side and top surfaces and being removably connected to said lower surface of said main vacuum canister, said top surface of said pan means having an opening to receive therethrough said lowermost tubular end portion of said intake means, said lowermost tubular end portion extending to a point near a surface of said filtering agent to thereby enable said dust and dirt entrained air ingested through said intake means to enter said interior area of said pan means.

2. The system of claim 1, wherein said shroud includes a plurality of openings for enabling visual access to an interior area defined by said shroud.

3. The system of claim 1, wherein said shroud comprises a generally circular skirt portion extending circumferentially about substantially the entire side surface of said main vacuum canister.

4. The apparatus of claim 1, wherein said intake means includes a generally circular opening disposed centrally within said intake means for enabling a separating element to protrude into said interior area of said pan means.

5. The system of claim 1, wherein said intake means is removably secured to said lower surface of said main vacuum canister.

6. The apparatus of claim 1, wherein pan means includes a handle portion.

7. The system of claim 6, wherein said handle portion is pivotally secured to said top surface of said pan means to enable said handle portion to be foldably collapsed into a stowed away position of non-use.

8. The system of claim 1, wherein said pan means includes means for filtering debris collected within said liquid filtering agent when said agent is emptied from said pan means.

9. The system of claim 8, wherein said filtering means comprises a comb removably secured to a portion of said top surface of said pan means.

10. The system of claim 9, wherein said comb is pivotally coupled to said top surface and includes a tab member adapted to be engaged by a finger of a user to thereby help enable said comb to be manually urged into and held in a desired position when said liquid filtering agent is emptied from said pan means, and wherein said pivotal coupling of said comb is offset from a vertical centerline through said comb to enable said comb to hang in a position close to said desired position to further facilitate filtering said debris.

11. The system of claim 1, wherein said pan means comprises a six-sided configuration.

12. The system of claim 1, wherein said pan means includes a pair of handles pivotally coupled to said top surface for enabling said pan means to be more easily manually articulated.

13. An intake assembly for a vacuum cleaner system comprising:

a main vacuum canister having a lower surface and a generally circular side surface;

an intake member for ingesting dust and dirt particulate entrained air, said intake member including a curved, downwardly protruding tubular member, said tubular member having a first opening defining an intake port, said intake port being formed within a portion of said side surface of said main vacuum canister, said tubular member further having a second opening defining an exhaust port, a portion of said tubular member protruding outwardly of said lower surface of said main vacuum canister;

said intake member including an integrally formed, downwardly depending shroud extending outwardly of said lower surface of said main vacuum canister assembly a distance at least equal to a distance at which said curved, downwardly protruding tubular member extends from said lower surface of said main vacuum canister, said skirt portion being operable to rest on a floor and support said main vacuum canister in a stabilized manner to prevent said main vacuum canister from tipping and wobbling relative to said floor; and a liquid pan assembly for containing a liquid filtering agent in an interior area thereof, said pan assembly having a lower surface, a generally circular side surface and a top surface adapted to be removably, nestably secured to said lower surface of said main vacuum canister, said top surface of said liquid pan assembly having a generally key-shaped opening for receiving therethrough a substantial portion of a separating element of said vacuum canister assembly and a lowermost tubular end portion of said tubular member of said intake member, said lowermost tubular end portion of said tubular member extending to a point closely adjacent a surface of said filtering agent.

14. The assembly of claim 13, wherein said liquid pan assembly includes a comb pivotally and removably secured to a portion of said key-shaped opening, said comb being operable to filter debris from said liquid filtering agent when said agent is emptied from said liquid pan assembly.

15. The assembly of claim 13, wherein said top surface of said liquid pan assembly includes an upwardly extending flange; and a handle portion pivotally coupled to said flange for facilitating handling of said liquid pan assembly, said handle portion being operable to fold pivotally into nesting engagement with a portion of said flange when said liquid pan assembly is to be secured to said lower surface of said main vacuum canister.

16. For a vacuum cleaner system having a main vacuum canister and a tubular intake member extending outwardly of a lower surface of the vacuum canister assembly, a liquid pan assembly comprising:

a liquid pan having a generally circular side surface and a top surface; and said top surface having an opening adapted to receive a portion of said tubular intake member to thereby enable said tubular intake member to be disposed adjacent a lower surface of said pan.

17. The liquid pan assembly of claim 16, wherein said top surface of said pan assembly includes a handle portion adapted to facilitate manual handling of said pan to thereby ease the manner in which a liquid filtering agent contained within said pan may be emptied therefrom.

18. The liquid pan assembly of claim 16, wherein said upper surface of said pan assembly includes a removable, pivotally secured comb for filtering debris from a liquid cleaning agent contained within said pan when said filtering agent is emptied from said pan.

19. For a vacuum cleaner system having a main vacuum canister a tubular intake member extending outwardly of a lower surface of the vacuum canister assembly, a liquid pan assembly comprising:

a liquid pan having a six-sided side surface and a top surface; and said top surface having an opening adapted to receive a portion of said tubular intake member to thereby enable said tubular intake member to be disposed adjacent a lower surface of said pan.

20. The liquid pan assembly of claim 19, wherein said top surface of said pan assembly includes a pair of handles adapted to facilitate manual handling and articulation of said liquid pan, said handles being foldable into a stowed away position when said liquid pan assembly is secured to a main vacuum canister.

* * * * *